US005205359A

United States Patent [19]

Stephenson

[11] Patent Number: 5,205,359

[45] Date of Patent: Apr. 27, 1993

[54] AUTOMATIC BALL INJECTOR APPARATUS AND METHOD

[75] Inventor: Stanley V. Stephenson, Duncan, Okla.

[73] Assignee: Halliburton Company, Duncan, Okla.

[21] Appl. No.: 761,208

[22] Filed: Sep. 17, 1991

[51] Int. Cl.[5] ..... E21B 33/13

[52] U.S. Cl. ..... 166/284; 166/53; 166/75.1

[58] Field of Search ..... 166/53, 70, 75.1, 284; 15/104.062; 137/268; 221/12, 13, 9; 222/55, 59, 60

[56] References Cited

U.S. PATENT DOCUMENTS

| | | | |
|---|---|---|---|
| 2,976,928 | 3/1961 | Gilbert | 166/284 X |
| 2,981,335 | 4/1961 | Bucy et al. | 166/284 X |
| 3,086,587 | 4/1963 | Zardmer et al. | 166/284 |
| 3,175,055 | 2/1973 | Kendrick et al. | 221/75 |
| 3,568,768 | 3/1971 | Rowell, Jr. | 166/329 X |
| 5,053,206 | 10/1991 | Maglio et al. | 137/268 X |
| 5,065,903 | 11/1991 | Meinz | 222/59 X |

OTHER PUBLICATIONS

GN International Inc. brochure entitled, "Model GN 201 & 202 Ball Injector", (more than one year before Sep., 1991) (Exhibit 1).

Universal Well Services Inc. Technical Bulletin entitled "Powerject Ball Gun", (more than one year before Sep. 1991) (Exhibit 2).

Halliburton Services Equipment Catalog pp. 6–18 entitled, "Special Equipment Shur Shot Ball Injector", (more than one year before Sep., 1991) (Exhibit 3).

Halliburton Services brochure entitled, "Arc System (Automated Remote Control)", (more than one year before Sep., 1991) (Exhibit 4).

*Primary Examiner*—William P. Neuder

*Attorney, Agent, or Firm*—James R. Duzan; E. Harrison Gilbert, III

[57] ABSTRACT

An apparatus injects sealing balls into a well in response to closed loop control. The apparatus measures the fluid flow into the well, computes a total amount of fluid which has been introduced into the well, and actuates the release of a sealing ball upon a predetermined amount of fluid being reached. A related method is also disclosed.

11 Claims, 2 Drawing Sheets

AUTOMATIC BALL INJECTOR APPARATUS AND METHOD

BACKGROUND OF THE INVENTION

This invention relates generally to apparatus and methods for injecting sealing balls into a well. The apparatus and method of the present invention use closed loop control to release balls in response to a sensed flow of a fluid which is pumped into a well and which carries the released balls with it.

In the completion of oil and gas wells, it is common practice to conduct a fracturing or other treating procedure. In a typical fracturing procedure, for example, the casing of the well is perforated to admit oil and/or gas into the well and fracturing fluid is then pumped into the well and through these perforations into the formation. Such treatment opens and/or enlarges draining channels in the formation, enhancing the producing ability of the well.

The treating fluid enters those zones of the formation having the highest permeability while the zones of the formation having lower permeabilities, and therefore requiring treatment the most, receive very little or none. It is well known to those skilled in the art to use sealing balls in order to temporarily block off the perforations leading to the higher-permeability zones to divert the treating fluid into the lower-permeability zones. These sealing balls are dispensed into the treating fluid and carried thereby to perforations through which the fluid is passing. The fluid pressure holds the balls in sealing positions thus blocking those perforations and forcing the fluid to other perforations.

Various ball injectors have been disclosed which inject perforation-sealing balls into the well. These units are operated either manually, in which an operator is required to release each ball, or automatically, in which an automatic timer injects a ball at a predetermined rate of time.

One disadvantage of the previous disclosures is that they are open-loop systems which inject balls according to time and not directly according to the amount of treating fluid pumped into the respective well. Thus, the release of a desired number of balls in these open-loop systems depends on there being a constant flow rate, which typically is not the case. That is, when balls are injected at predetermined time intervals, varying fluid flow rates will cause either too many or too few balls to be released relative to the amount of fluid pumped. Releasing too many sealing balls causes perforations to be sealed prematurely before the desired volume of treating fluid can be placed through those perforations. This defeats the purpose of fracturing, that being to enlarge the zones of draining channels. Releasing too few sealing balls presents the same problems which existed before the sealing balls were used, that being the lower-permeability zones receiving insufficient fracturing fluids; this allows more than the desired amount of treating fluid to enter higher flowing perforations. This is wasteful and expensive and can damage the formation.

To overcome the foregoing shortcoming, there is the need for an apparatus and method which can inject balls in relation to the fluid flow amount so that only desired amounts are pumped through perforations before they are blocked off by a desired number of sealing balls.

SUMMARY OF THE INVENTION

The present invention overcomes the above-noted and other shortcomings of the prior art by providing a novel and improved sealing ball injection apparatus and method. The present invention uses closed loop control so that the invention automatically regulates the release of the sealing balls based on the flow of the treating fluid (e.g., fracturing fluid) pumped into the well. Insofar as I am aware, no prior art ball injector has utilized the closed-loop feature incorporating the release of sealing balls directly in relation to the fluid-flow amount.

The present invention allows one to place measured amounts of fracturing fluids through perforations before sealing them. Once a measured amount of fluid is released, a desired number of sealing balls are injected to fill the most free-flowing holes. Subsequently, another measured amount of fluid is pumped into the well, to flow into the next highest flowing perforations, after which another desired number of sealing balls are released. By continuing this process, desired quantities of treating fluid can be placed through different sets of perforations despite their differences in permeability. This allows a formation to be treated in close correspondence to a specific design derived by an engineer or the like for the particular well.

The apparatus of the present invention comprises means for controllably releasing sealing balls into a fluid flowing into the well; and means for controlling the ball releasing means in response to the fluid flowing into the well so that the controlling means automatically adjustably regulates the release of the sealing balls from the ball releasing means in closed loop response to variations in the fluid flowing into the well.

The present invention also provides a method for controlling the injection of sealing balls into a well comprising the steps of sensing a fluid flowing into the well and actuating a ball injector connected to the well in response to the sensed fluid flow.

Therefore, from the foregoing, it is a general object of the present invention to provide a novel and improved automatic ball injector apparatus and method. Other and further objects, features and advantages of the present invention will be readily apparent to those skilled in the art when the following description of the preferred embodiments is read in conjunction with the accompanying drawings.

DETAILED DESCRIPTION OF THE PREFERRED EMBODIMENTS

Figure 1:
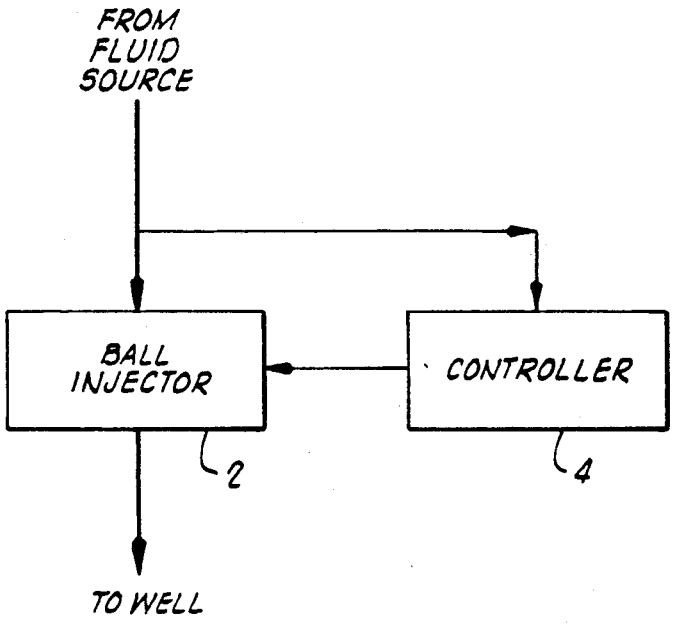
FIG. 1 is a block diagram of the apparatus of the present invention.

FIG. 1 illustrates the closed-loop embodiment of the apparatus of the present invention. A ball injector 2 is actuated by a controller 4 which responds to flow into the well through the ball injector 2. The ball injector 2 is preferably a conventional ball injector which controllably releases one or more perforation sealing balls into the fluid flow when actuated in a known manner (e.g., by a rotary action). The fluid is preferably a suitable treating fluid (e.g., a fracturing or acidizing fluid) prepared and pumped in a known manner.

Figure 2:
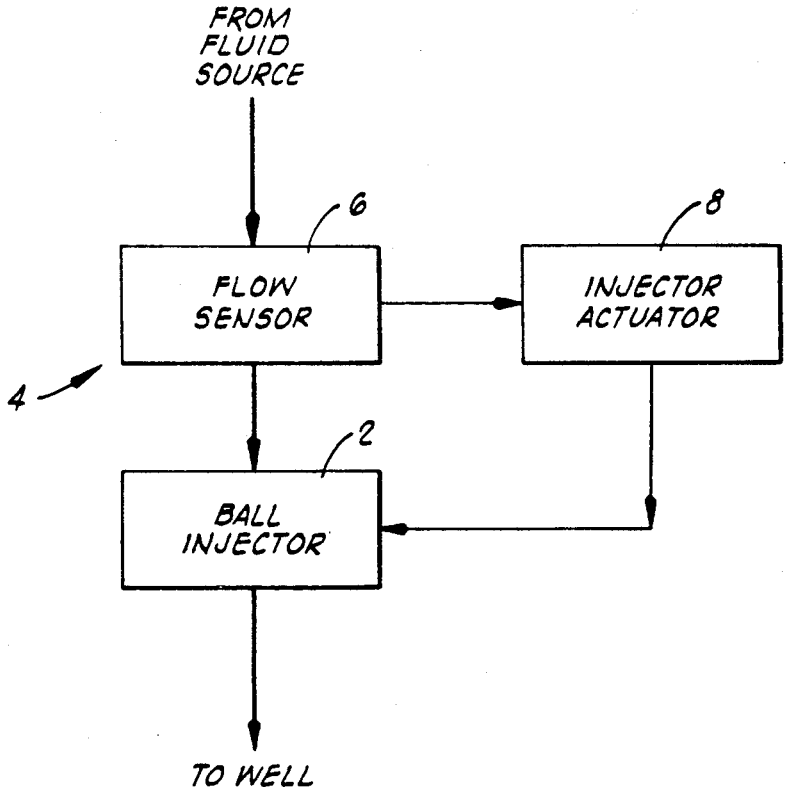
FIG. 2 is a more detailed block diagram of the apparatus of the present invention.

Referring to FIG. 2, the controller 4 includes a flow sensing means 6 and a ball injector actuating means 8. The sensing means 6 sends an encoded electrical signal to the actuating means 8 based upon the sensed flow of the fluid. In response to the encoded signal, the actuating means 8 computes the amount of fluid flow and, upon a predetermined amount of fluid flow being reached, actuates the ball injector 2 to release one or more sealing balls carried in the ball injector 2. The controller 4 is preferably implemented with suitable electrical elements so that the controller 4 automatically adjustably regulates the release of the sealing balls from the ball injector 2 in closed loop response to variations in the fluid flowing into the well.

Figure 3:
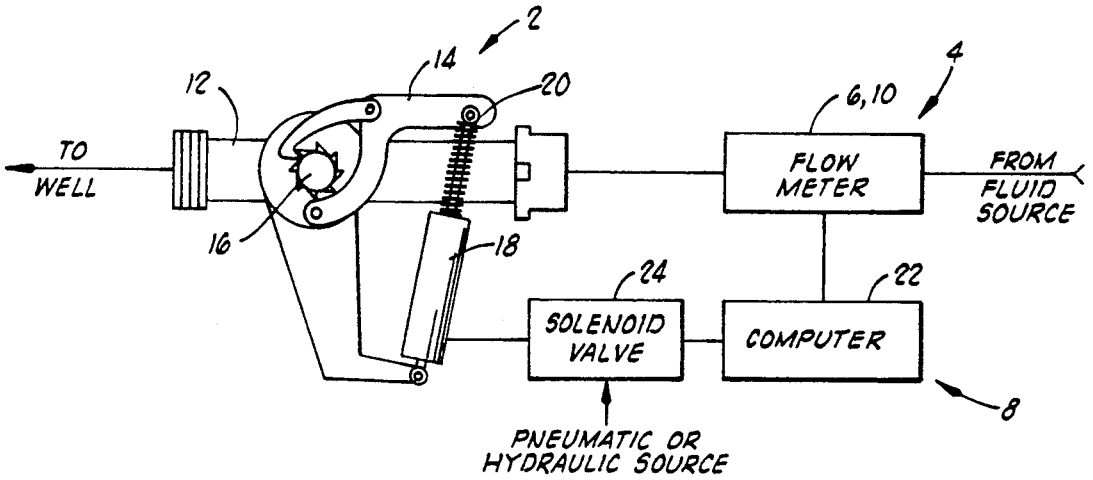
FIG. 3 is a schematic and block diagram of a preferred embodiment automatic ball injection apparatus of the present invention.

FIG. 3 shows a more particular preferred embodiment of the invention. The ball injector 2 has a body 12 in which the sealing balls are held by a ratchet release mechanism including a pawl 14 and a ratchet wheel 16. A pneumatically or hydraulically driven cylinder 18 has a spring-biased rod 20 connected to the pawl 14. The flow sensing means 6 includes a conventional flow meter 10 (e.g., a Halliburton Services turbine flow meter) suitable for the particular fluid which the flow meter 10 is to sense. The actuating means 8 includes a computer 22 and a solenoid valve 24. The computer 22 computes the desired flow characteristic (e.g., total volume of flow in the preferred embodiments) and generates an electrical control signal to open the normally closed solenoid valve 24 when a predetermined flow parameter pre-programmed into the computer is met. Opening the solenoid valve 24 communicates the source of pneumatic or hydraulic driving fluid with the cylinder 18. This retracts the cylinder rod 20, thereby pivoting the pawl 14 and rotating the ratchet wheel 16. When the ratchet wheel has been rotated through the appropriate angle, a ball is released from the body 12 of the ball injector 2.

As the flow meter 10 senses the flow of the treating fluid, it generates an encoded electrical signal to the computer 22. In the preferred embodiment, the computer 22 can be implemented by the microprocessor-based unit controller on the instrument skid of the Halliburton Services ARC System as programmed using known programming skills.

Figure 4:
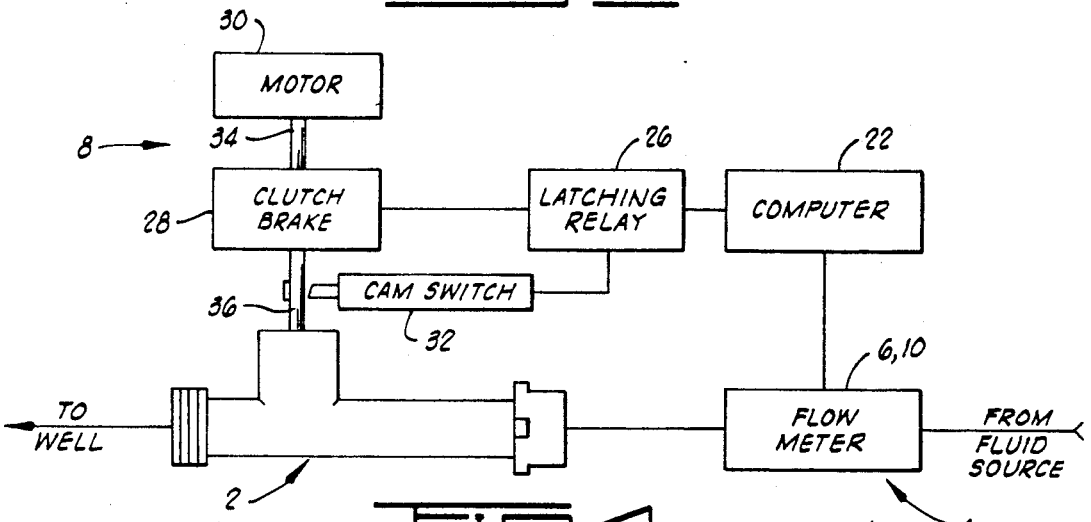
FIG. 4 is a schematic and block diagram of another preferred embodiment automatic ball injection apparatus of the present invention.

FIG. 4 shows another particular embodiment of the apparatus of the present invention. This embodiment functions the same as the embodiment of FIG. 3 except for the specific mechanism for rotating the ball release mechanism of the ball injector 2. This specific mechanism, which is part of the actuating means 8 for the FIG. 4 embodiment, includes a latching relay 26, a clutch/brake assembly 28, a motor 30, and a cam switch 32.

Upon a predetermined amount of fluid flow having occurred as computed by the computer 22, the computer 22 generates an electrical control signal and sends it to the latching relay 26. In response, the latching relay 26 actuates the clutch and brake assembly 28 to engage a drive shaft 34 of the motor 30 with a shaft 36 connected to or extending from the ball injector 2. The drive shaft 34 is continuously rotated by the motor 30, which can be electric, pneumatic, or hydraulic. Upon energization of the clutch of the assembly 28, the shaft 34 engages the shaft 36 and rotates the shaft 36 a proper amount to actuate the release of a ball from the ball injector 2. With regard to the ball injector 2, there needs to be a certain degree of rotation in order for a ball to be released (based upon the conventional ball injector). The shape of the shaft 36 and the cam switch 32 are configured and cooperate to generate an electrical signal from the switch 32 to the latching relay 26 to disengage the clutch and apply the brake of the assembly 28 upon release of a ball. The latching relay 26 then awaits another control signal from the computer 22 in order to actuate the injection of another ball.

Figure 5:
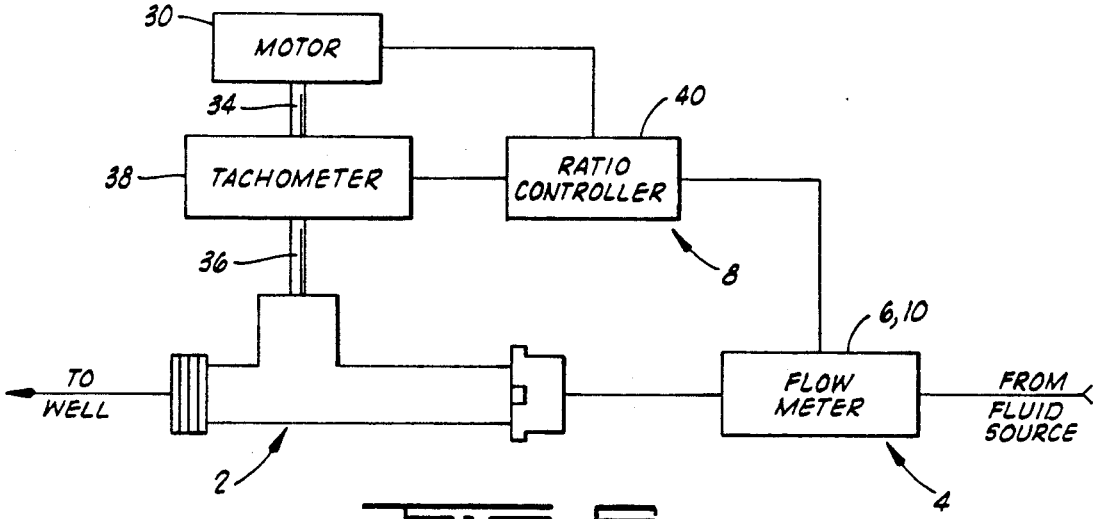
FIG. 5 is a schematic and block diagram of still another preferred embodiment automatic ball injection apparatus of the present invention.

Another particular embodiment of the apparatus of the present invention is shown in FIG. 5. The ball injector 2 of this embodiment is also responsive to rotary movement for releasing a ball. The rotary member of the ball injector 2 in this embodiment is continuously moved, but at a speed which varies in response to the flow sensed by the flow meter 10.

The ball injector 2 has the shaft 36 as in the FIG. 4 embodiment. The shaft 36 is continuously connected to the drive shaft 34 of the motor 30 so that the shaft 36 moves when the drive shaft 34 moves. The speed of rotation of this movement is sensed and measured by a conventional tachometer 38 suitable for its particular application.

The electrical output provided by the tachometer 38 in a known manner is received by a ratio controller 40. The ratio controller also receives the electrical signal provided by the flow meter 10. In response to these inputs, the ratio controller 40 controls the speed at which the motor 30 rotates the coupled shafts 34, 36.

The ratio controller 40 provides means for adjusting the speed of rotation of the shafts 34, 36 so that their speed of rotation is controlled to release balls from the ball injector 2 after desired amounts of fluid have been pumped into the well as sensed by the flow meter 10. Preferably the ratio controller 40 is any suitable electrical device for implementing this means, such as a microprocessor-based device programmed with desired predetermined flow amounts at which balls are to be released and with necessary information as to how far the shafts 34, 36 must be rotated to effect ball release. With this information and the inputs from the flow meter 10 and the tachometer 38, the ratio controller 40 can properly control the motor 30.

Regardless of the particular implementation of the apparatus of the present invention as generally depicted in FIGS. 1 and 2, the method of the present invention, whereby the injection of sealing balls into a well is controlled, comprises the steps of sensing a fluid flowing into the well, and actuating a ball injector connected to the well in response to the sensed fluid flow. In the preferred embodiments, actuation occurs when a control signal is generated upon a predetermined flow amount being sensed and the control signal is applied to operate the ball injector 2 so that it releases a ball. This release can occur by any suitable steps. Referring to the embodiments of FIGS. 3–5, release can be by controlling the solenoid valve 24 with the generated control signal (FIG. 3), by controlling the clutch of the assembly 28 with the generated signal (FIG. 4), or by variably adjusting the speed of the motor 30 and thus the speed of operation of the ball injector 2) with the generated signal (FIG. 5). In all cases, the ball injector 2 is directly controlled in response to actual fluid flow so that the release of balls is properly coordinated with actual fluid flow This closed loop control assures that proper amounts of treating fluid will be placed in the well before balls are injected.

Thus the present invention for injecting sealing balls into a well in direct relation to the actual fluid flow is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for injecting sealing balls into a well, comprising:

means for controllably releasing sealing balls into a fluid flowing into the well; and means for controlling said ball releasing means in response to the fluid flowing into the well so that said controlling means automatically adjustably regulates the release of the sealing balls from said ball releasing means in closed loop response to variations in the fluid flowing into the well, said controlling means including:

means for sensing the fluid flowing into the well, said sensing means comprising a flow meter; and means, responsive to said sensing means, for actuating said ball releasing means, said actuating means including:

means for computing the amount of fluid flowing through said flow meter; and valve means, connected to said computing means, for operating said ball releasing means in response to said computing means.

2. An apparatus as recited in claim 1, wherein said valve means includes a solenoid valve connected to said computing means and said ball releasing means.

3. An apparatus for injecting sealing balls into a well, comprising:

means for controllably releasing sealing balls into a fluid flowing into the well; and means for controlling said ball releasing means in response to the fluid flowing into the well so that said controlling means automatically adjustably regulates the release of the sealing balls from said ball releasing means in closed loop response to variations in the fluid flowing into the well, said controlling means including:

means for sensing the fluid flowing into the well, said sensing means comprising a flow meter; and means, responsive to said sensing means, for actuating said ball releasing means, said actuating means including:

means for computing the amount of fluid flowing through said flow meter;

a motor having a drive shaft; and means, connected to said motor and said computing means, for operatively engaging said drive shaft with said ball releasing means in response to said computing means determining a predetermined total fluid has flowed through said flow meter.

4. An apparatus for injecting sealing balls into a well, comprising:

means for controllably releasing sealing balls into a fluid flowing into the well; and means for controlling said ball releasing means in response to the fluid flowing into the well so that said controlling means automatically adjustably regulates the release of the sealing balls from said ball releasing means in closed loop response to variations in the fluid flowing into the well, said controlling means including:

means for sensing the fluid flowing into the well, said sensing means comprising a flow meter; and means, responsive to said sensing means, for actuating said ball releasing means, said actuating means including:

a motor having a drive shaft;

means for measuring the speed of rotation of said drive shaft; and means, responsive to said measuring means and said flow meter, for adjusting the speed of rotation of said drive shaft so that said drive shaft operates said ball releasing means to release a ball in response to a predetermined fluid flow sensed by said flow meter.

5. An automatic ball injection apparatus for injecting a sealing ball into a well, comprising:

a ball injector;

a flow meter connected in fluid communication with said ball injector; and an actuator connected to said ball injector and said flow meter to actuate the release of a sealing ball from said ball injector in response to said flow meter, wherein said actuator includes:

a solenoid valve connected to said ball injector; and means, connected to said flow meter and said solenoid valve, for computing the flow of a fluid through said flow meter and for energizing said solenoid valve in response to computing a predetermined flow.

6. An automatic ball injection apparatus for injecting a sealing ball into a well, comprising:

a ball injector;

a flow meter connected in fluid communication with said ball injector; and an actuator connected to said ball injector and said flow meter to actuate the release of a sealing ball from said ball injector in response to said flow meter, wherein said actuator includes:

a motor having a drive shaft;

a clutch connected to said drive shaft and to said ball injector; and means, connected to said flow meter and to said clutch, for operating said clutch in response to said flow meter so that said clutch engages said drive shaft with said ball injector in response to a predetermined total flow sensed by said flow meter and so that said clutch disengages said drive shaft from said ball injector after a ball has been injected by said ball injector.

7. An automatic ball injection apparatus for injecting a sealing ball into a well, comprising:

a ball injector;

a flow meter connected in fluid communication with said ball injector; and an actuator connected to said ball injector and said flow meter to actuate the release of a sealing ball from said ball injector in response to said flow meter, wherein said actuator includes:

a motor;

a tachometer responsive to the speed of said motor; and ratio controller means, responsive to said tachometer and said flow meter, for adjusting the speed of said motor in response to a flow of fluid sensed by said flow meter.

8. A method for controlling the injection of sealing balls into a well, comprising the steps of:

a) sensing a fluid flowing into the well; and b) actuating a ball injector connected to the well in response to the sensed fluid flow, wherein said actuating includes generating an electrical signal upon a predetermined flow amount being sensed and operating the ball injector in response to the generated electrical signal.

9. A method as recited in claim 8, wherein said actuating further includes controlling a solenoid valve, connected to the ball injector, with the generated electrical signal.

10. A method as defined in claim 8, wherein said actuating further includes controlling a clutch, connected to the ball injector, with the generated electrical signal.

11. A method for controlling the injection of sealing balls into a well, comprising the steps of:

a) sensing a fluid flowing into the well; and b) actuating a ball injector connected to the well in response to the sensed fluid flow, wherein said actuating includes variably adjusting the speed of a motor operating the ball injector in response to the sensed fluid flow.

* * * * *